United States Patent [19]

Delman

[11] Patent Number: 4,516,356

[45] Date of Patent: May 14, 1985

[54] INSULATED PLASTIC FRAME FOR DOORS, WINDOWS AND THE LIKE

[76] Inventor: Ralph Delman, 2914 Hardale, Toledo, Ohio 43606

[21] Appl. No.: 561,304

[22] Filed: Dec. 14, 1983

[51] Int. Cl.[3] ..... E06B 1/04

[52] U.S. Cl. ..... 49/504; 49/404

[58] Field of Search ..... 49/504, 505, DIG. 2, 49/404; 52/204, 211, 212, 213, 214, 215, 309.9

[56] References Cited

U.S. PATENT DOCUMENTS

| | | | |
|---|---|---|---|
| 3,175,256 | 3/1965 | Horton | 49/489 |
| 4,259,813 | 4/1981 | Winner et al. | 49/504 |
| 4,281,492 | 8/1981 | Schock et al. | 52/309.9 |
| 4,286,716 | 9/1981 | Budich et al. | 49/504 X |
| 4,299,060 | 11/1981 | Tippmann | 52/212 X |
| 4,351,131 | 9/1982 | Kubik | 49/504 |

FOREIGN PATENT DOCUMENTS

| | | | |
|---|---|---|---|
| 2316347 | 10/1974 | Fed. Rep. of Germany | 52/309.9 |
| 1436290 | 5/1976 | United Kingdom | 49/504 |

*Primary Examiner*—Philip C. Kannan

*Attorney, Agent, or Firm*—Willian Brinks Olds Hofer Gilson & Lione

[57] ABSTRACT

An insulated vinyl window frame includes at least one passageway having insulation disposed therein. The insulation may be either foamed in place or rigid material which is formed to size and then inserted into the passageway during assembly of the frame. Preferably, the passageway walls include a plurality of ribs which position the rigid insulation a small interval from the walls defining and sealing off air spaces between the walls and the insulation thereby providing small, substantially non-circulating regions of air. Since the air has a heat resistance value greater than most other construction and insulating materials such as plastic, glass, rubber or metal, the window frame exhibits extraordinary insulating characteristics. Plural passageways in both vertical and horizontal members of the frame having plural ribs which extend between the walls of the passageway and the rigid insulation to both support the insulation and seal and define a plurality of substantially non-circulating regions of air are also comprehended by the instant invention.

11 Claims, 5 Drawing Figures

INSULATED PLASTIC FRAME FOR DOORS, WINDOWS AND THE LIKE

BACKGROUND OF THE INVENTION

The invention relates generally to energy conservation structures and more specifically to an insulated vinyl window frame having insulated passageways disposed therein.

With the current emphasis on energy conservation, especially in the home, all aspects of construction components and methods have been carefully examined and oftentimes redesigned in an attempt to improve their energy conservation characteristics. With regard to windows and doors, such examination and redesign takes the form of the utilization of materials having high thermal resistance, the addition of insulating materials and the improvement of seal structures.

At one time, the window industry moved away from wood frames to aluminum frames for their ease of manufacture and assembly as well as lower cost. Unfortunately, the thermal conductivity of such frames creates a visible, undesirable side effect, namely, condensation on the interior surfaces during periods of cold weather. A less apparent though more economically significant difficulty of such frames is the energy loss through them due to their rather high thermal conductivity. U.S. Pat. Nos. 3,600,857 and 4,151,682 both address this difficulty. Both suggest the use of a thermal barrier or break of an insulating material between the inside and outside regions of the frame thereby interrupting what is otherwise rather significant thermal communication between the inside and the outside of a building, thereby reducing the condensation problem and the thermal losses attendant the significant thermal conduit provided by a metal structure extending from the inside heated space of a building to the outside.

Another construction approach which reduces the thermal conductivity of window and door frames is the utilization of plastic material such as vinyl to form portions of the frame. U.S. Pat. No. 4,286,716 teaches a composite frame having plastic inserts disposed in a metal support frame. Insulation is incorporated in the frame but the use of metal offsets the insulating effect of the insulation. This design, therefore, does not achieve the maximum possible insulating characteristics.

From the foregoing, it should be apparent that additional improvements directed to reducing the thermal conductivity of window and door frames are possible.

SUMMARY OF THE INVENTION

A fundamental and often overlooked characteristic of insulating materials is the rather significant difference between the thermal conductivities of gases and solids. For example, the thermal conductivity of air is generally an order of magnitude lower than that associated with any solid such as wood and plastic and extraordinarily lower than any metal. Utilization of air as an insulator is not without a significant problem, however. The problem, of course, is that any sizeable volume of air disposed between surfaces at different temperatures will begin to circulate and such convective heat transfer effectively and significantly increases the thermal conductivity of the air. The instant invention is thus directed to an insulated plastic structure such as a window or door frame and specifically to such a structure having insulation surrounded by air in relatively small, non-circulating regions. The window or door frame according to the instant invention is preferably an extruded plastic structure having at least one and preferably a plurality of passageways extending therealong. Within at least one of the channels is disposed insulation. The insulation may either be foamed in place or may be of a rigid, properly sized shape such that it may be inserted into the passageways during assembly of the frame. Preferably, the walls of the passageway each include at least one rib which positions the rigid insulation form away from the walls and defines and confines a region of substantially non-circulating air. In this manner, the superior characteristic of air as an insulator is combined with the necessary feature of non-circulation and the low thermal conductivities of insulation and plastic frame structures to provide a door or window frame having superior heat transfer resistance. Several different configurations of passageway size and placement as well as rib placement and thus size and number of confined air regions are possible and generally may be chosen to suit various size, material consumption and heat insulating requirements.

Thus it is an object of the instant invention to provide a door or window frame having improved insulating characteristics.

It is a further object of the instant invention to provide a plastic window frame having passageways filled with insulating material to provide a frame having superior heat insulating characteristics.

It is a still further object of the instant invention to provide a plastic, extruded window frame having an insert of rigid insulating material disposed within a passageway and supported there by ribs which seal off and define regions of substantially non-circulating air.

Further objects and advantages of the instant invention will become apparent by reference to the following description of the preferred embodiments and appended drawings.

DESCRIPTION OF THE PREFERRED EMBODIMENT

Figure 1:
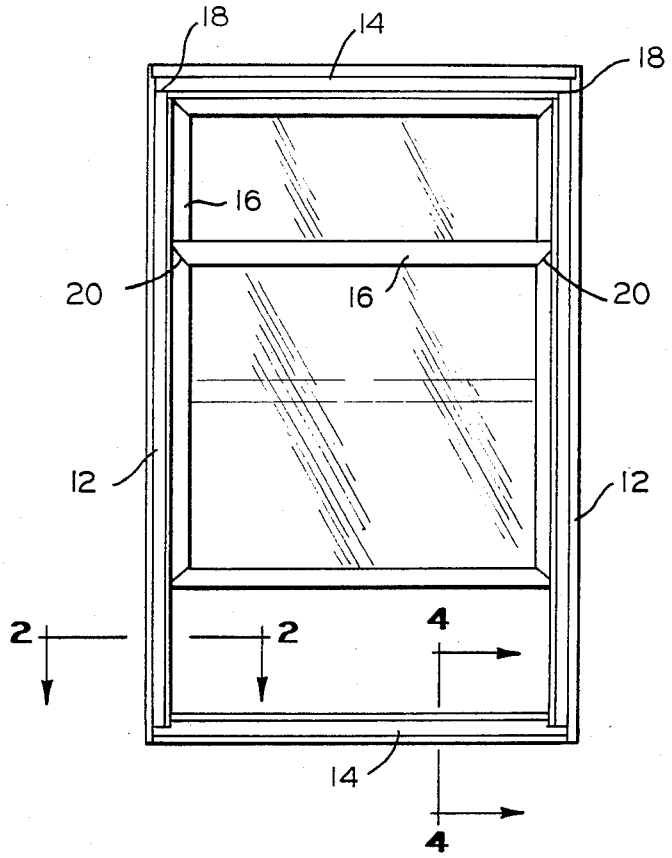
FIG. 1 is a front, elevational view of a frame of, for example, a window, incorporating the instant invention.

Referring now to FIG. 1, a frame for a window is illustrated and generally designated by the reference numeral 10. Although the invention will be described with reference to the window frame 10, it will be readily apparent to those skilled in the art that the invention may be applied to other similar structural components such as door frames and fixed window frames for use in components such as skylights and the like. The window frame 10 includes a pair of vertical side members 12 interconnected by a pair of upper and lower horizontal members 14. Disposed within the frame 10 is a pair of sashes 16 arranged in parallel planes for sliding movement within the frame 10 according to conventional practice. Again it should be noted that although the window frame 10 illustrated is of the design commonly referred to as double hung, inasmuch as the invention relates primarily to the frame members 12 and 14, it should be understood that other window designs such as awning, casement and jalousie windows, to name but three, are comprehended by and included within the instant invention. Preferably, the frame members 12 and 14 as well as the sash members 16 are fabricated of a plastic, weather-resistant material such as vinyl or polyvinylchloride or similar material having suitable strength, weather resistance and low conductivity. As illustrated, the frame members 12 and 14 intersect along rabbeted or notched joints 18 and are secured together by screws (not illustrated) and PVC cement. The components of the sash 16 have mitered corners 20 and are secured to one another by suitable fastening means including screws, corner gussets (both not illustrated) and/or thermowelding or gluing agents such as PVC cement.

Figure 2:
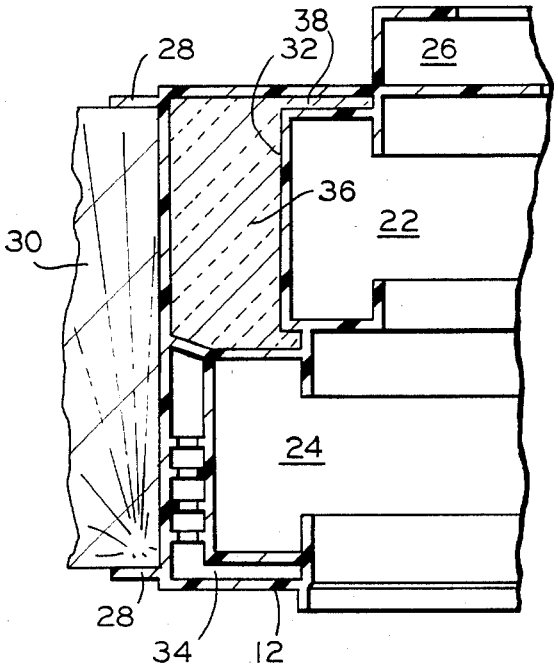
FIG. 2 is a full, sectional view of a first embodiment of a frame incorporating the instant invention taken along line 2—2 of FIG. 1.

Referring to FIGS. 1 and 2, a section through one of the side members 12 according to a first embodiment is illustrated. As noted previously, preferably the side member 12 is a plastic extrusion and, as such, includes channels and various features which extend uniformly along its full length as those familiar with extruded products will readily understand. The side member 12 includes a first open channel 22 for receiving one of the sashes 16 and a second open channel 24 for receiving the other of the sashes 16. The side member 12 also includes a channel 26 about its outer surface suitable for receiving a screen (not illustrated) or similar structure. On the outer face of the side member 12 is disposed a pair of rails 28 which fit over and engage structural members 30 in the house, building or structure in which the window assembly 10 is disposed. Also defined by the side member 12 is a generally rectangular passageway 32 which likewise extends its full length. The passageway 32 is generally adjacent the first sash receiving channel 20. A second passageway 34 is also defined by the side member 12 and is disposed generally adjacent the second sash receiving channel 24. Disposed within the passageway 32 is an insulating material 36 such as styrofoam, fiberglass, or foamed in placed plastic material such as urethane. In this embodiment, the insulation 36 thus substantially fills the passageway 32 and provides a significant barrier to the transfer of heat through the side member 12. It should be noted that foamed in place products enhance the overall insulating characteristics of the side member 12 by filling all voids, small channels and other areas such as the narrow channel 38.

Figure 3:
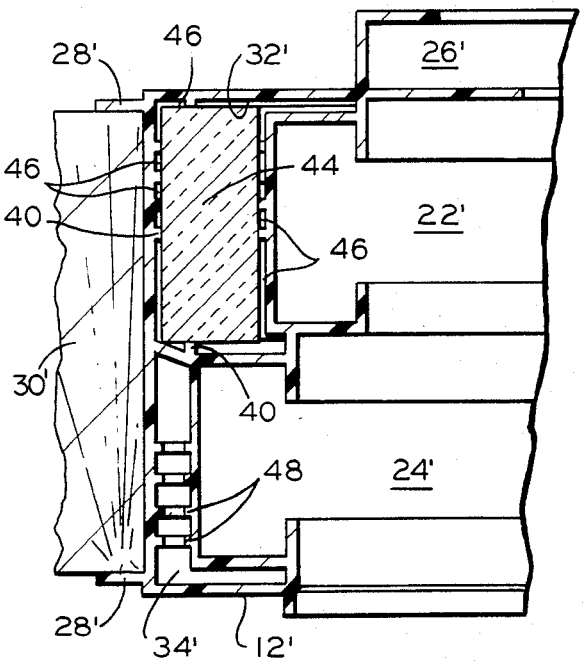
FIG. 3 a full, sectional view of a second embodiment of a frame incorporating the instant invention taken along line 2—2 of FIG. 1.

Referring now to FIGS. 1 and 3, a second embodiment of the window assembly, 10', is illustrated. Again, the side member 12' includes a first open channel 22' for receiving one of the sashes 16 and a second open channel 24' for receiving the other of the sashes 16. The side member 12' also includes a channel 26' about its outer surface suitable for receiving a screen (not illustrated) or similar structure. On the outer face of the side member 12' are disposed a pair of rails 28' which fit over and engage structural members 30' in the house, building or structure in which the window assembly 10' is disposed. Also defined by the side member 12' is a generally rectangular passageway 32' which likewise extends the full length of the member 12'. The passageway 32' is generally adjacent the first sash receiving channel 22'. A second passageway 34' is also defined by the side member 12' and is disposed generally adjacent the second sash receiving channel 24'. The sidewalls of the passageway 32' include a plurality of spaced-apart ribs 40. The ribs 40 may be arranged in various configurations as illustrated but there is preferably disposed at least one rib 40 along each of the four interior faces of the passageway 32' as illustrated. Plural ribs 40 disposed along any of the walls of the passageway 32' are of generally equal height on any given wall such that the ends of the ribs 40 define a plane. The number of ribs 40 may be varied in accordance with design criteria such as strength of the member 12' or increased number of air chambers as will be described below. Spaced from the passageway walls and supported by the ribs 40 is a rigid elongate insert of insulation 44. The insulation 44 is preferably a rigid foam material such as styrofoam or urethane which maintains its shape such that it is spaced from the walls of the passageway 32' and contacted substantially only by the ribs 40 and thus defines a plurality of air pockets 46 disposed about its periphery. The plural air pockets 46 are small enough to substantially eliminate air circulation and thus heat transfer by convection but are large enough such that the benefits of the low heat transfer characteristics of air significantly improve the overall insulating characteristics of the side member 12'. As illustrated, the side member 12' also includes a passageway 34' generally adjacent the second sash receiving channel 24'. The passageway 34' likewise includes a plurality of ribs 48 extending inwardly from the wall surfaces. The ribs 48 again function both to strengthen the side member 12' as well as reduce air circulation within the passageway 34' thereby improving the insulating characteristics of the overall side member 12'.

Figure 4:
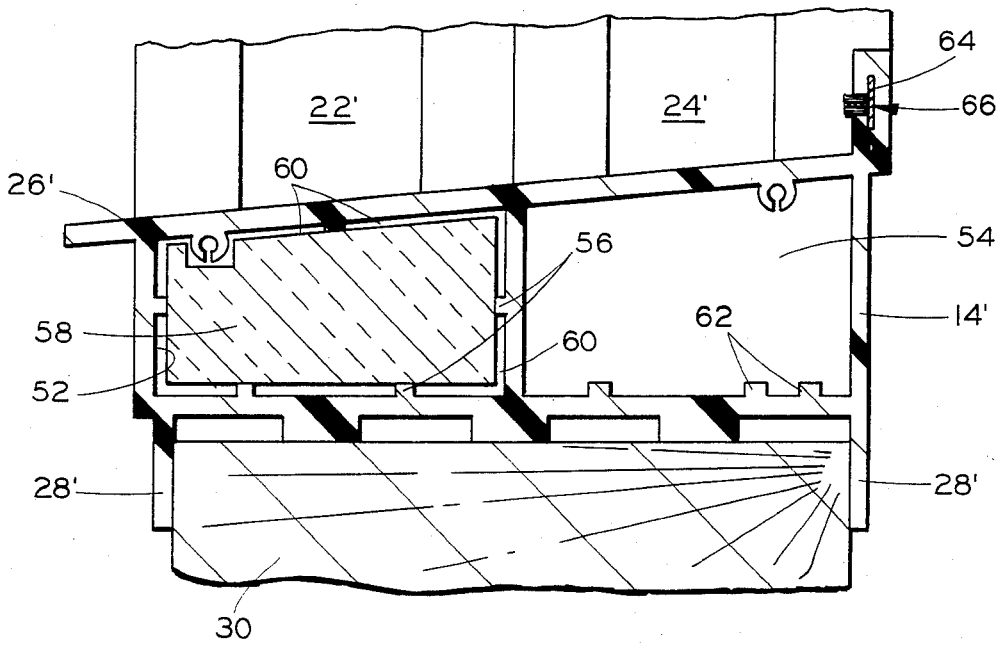
FIG. 4 is a full, sectional view of the sill portion of a second embodiment of a frame incorporating the instant invention line 4—4 of FIG. 1.

Referring now to FIGS. 1 and 4, the lower horizontal member 14, i.e., the sill portion, of the second embodiment is illustrated in section and again defines the screen receiving slot 26', the rails 28' which fit over the building structure 30' and a pair of passageways 52 and 54 which are disposed in general alignment with a respective sash member 16. Again the walls of the passageway closer to the outside, namely, the passageway 52, includes a plurality of ribs 56 which support an insert of rigid insulation 58 and define a plurality of closed and therefore substantially non-circulating regions 60 filled with air. Again the precise number of the ribs 56 is not critical although, of course, at least one rib preferably extends inwardly from each of the walls of the passageway 52 and, if plural ribs are disposed along one of the walls, the ends of the ribs 56 are preferably aligned in a co-planar fashion such that each seals against the insulation 58 as illustrated in FIG. 4. The passageway 54 may also include a plurality of ribs 62 which both strengthen the horizontal member 14 and limit the circulation of the air within the passageway 54 to improve its insulating characteristics.

Figure 5:
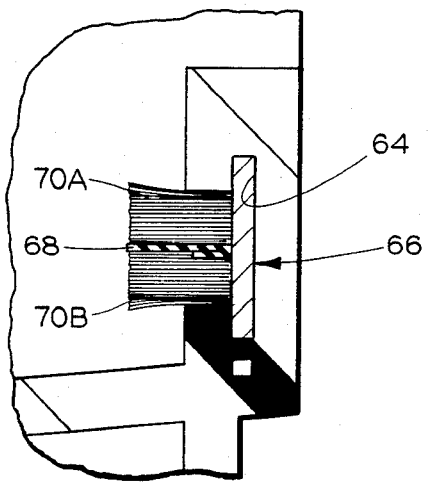
FIG. 5 is an enlarged, fragmentary sectional view of a sill portion of a second embodiment of a frame incorporating the instant invention taken along line 4—4 of FIG. 1.

FIG. 5 illustrates on an enlarged scale a channel 64 which extends uniformly across the sill or horizontal member 14 and receives a weatherstripping assembly 66. The weatherstripping assembly 66 includes a centrally disposed resilient leaf 68 flanked on both sides by brush like projecting strips of fibers 70A and 70B. The weatherstripping assembly 66 provides a seal against the lower outer member of the sash 16 and minimizes air infiltration.

Thus it will be apparent from the foregoing description that the instant invention provides a means whereby window and door frames combine the excellent insulating characteristics of vinyl and other plastics with additional insulating material in both the horizontal and vertical frame members. Preferably, small longitudinally extending regions occupied by air surround the insulation. So disposed, circulation and convective heat losses are minimized and the superior insulating characteristics of air is utilized.

The foregoing disclosure is the best mode devised by the inventor for practicing this invention. It is apparent, however, that apparatus incorporating modifications and variations will be obvious to one skilled in the art of insulated building structures. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

I claim:

1. An insulated frame for doors, windows and the like comprising, in combination, a plurality of elongate frame sections each having notched corners and joined to an adjacent said frame section at a right angle, each of said elongate frame sections defining a plastic extrusion having at least one internal passageway extending along its length, said passageway having a plurality of surfaces, at least a pair of said sections defining at least one channel for receiving an associated movable panel, insulating means disposed in said passageway for reducing heat transfer therethrough and means for positioning said insulation away from at least one of said surfaces and defining an air filled region between said one of said surfaces and said insulation.

2. The insulated frame of claim 1 wherein said frame includes four frame sections and defines a rectangle.

3. The insulated frame of claim 1 wherein each of said elongate frame sections defines a plastic extrusion having a uniform cross-section.

4. The insulated frame of claim 1 further including a pair of spaced-apart parallel rail means extending from one side of said plastic extrusion for receiving a structural member therebetween.

5. The insulated frame of claim 1 wherein said positioning means are ribs and at least one rib is disposed on each of said surfaces of said passageway.

6. The insulated frame of claim 1 wherein said insulating means is rigid.

7. The insulated frame of claim 1 further including a second passageway disposed generally parallel to said internal passageway.

8. The insulated frame of claim 7 wherein said second passageway includes a plurality of ribs disposed on its inner surfaces.

9. The insulated frame of claim 1 further including a weatherstrip assembly having a resilient leaf flanked by a pair of strips or fibers disposed in at least one of said frame sections.

10. The insulated frame of claim 1 wherein said movable panel is a sash having a plurality of frame members coupled to adjacent said frame members at mitered corners.

11. The insulated frame of claim 1 wherein said pair of said sections define at least a pair of parallel channels for receiving a respective pair of movable panels, said movable panels each comprising a plurality of frame members, said frame member disposed at right angles to one another and coupled to the other at mitered corners.

* * * * *